United States Patent [19]

Suzuki

[11] Patent Number: 4,609,851

[45] Date of Patent: Sep. 2, 1986

[54] ELECTRONIC FLASH SYSTEM WITH CONTROL OF COMMUTATION CAPACITOR

[75] Inventor: Toru Suzuki, Tokyo, Japan

[73] Assignee: Tokyo Kogaku Kikai Kabushiki Kaisha, Tokyo, Japan

[21] Appl. No.: 634,681

[22] Filed: Jul. 25, 1984

[30] Foreign Application Priority Data

Jul. 29, 1983 [JP] Japan ..... 58-139197

[51] Int. Cl.[4] ..... H05B 41/32

[52] U.S. Cl. ..... 315/241 P; 315/240; 354/416

[58] Field of Search ..... 315/241 P, 240, 120, 315/123; 354/416, 417

[56] References Cited

U.S. PATENT DOCUMENTS 3,878,429 4/1975 Iwata ..... 315/241 P X
3,998,534 12/1976 Schulze et al. ..... 315/241 P X
4,214,825 7/1980 Mizokami ..... 354/416
4,217,523 8/1980 Hirata ..... 315/241 P
4,494,044 1/1985 Kataoka ..... 315/241 P X
4,510,419 4/1985 Takematsu ..... 315/241 P

*Primary Examiner*—David K. Moore
*Assistant Examiner*—Vincent DeLuca
*Attorney, Agent, or Firm*—Brumbaugh, Graves, Donohue & Raymond

[57] ABSTRACT

An electronic flash including a discharge flash tube controlled by a first switch and a commutation capacitor for controlling the first switch. There is provided a second switch for governing the operation of the commutation switch. A charging circuit is provided for charging the commutation capacitor and includes a resistor connecting the commutation capacitor with an electric power source. The resistor has a resistance value which is small enough to allow a current not smaller than a current at which the second switch is turned off.

5 Claims, 4 Drawing Figures

ELECTRONIC FLASH SYSTEM WITH CONTROL OF COMMUTATION CAPACITOR

DESCRIPTION OF THE INVENTION

The present invention relates to an electronic flash system for photographing cameras, and more particularly to an electronic flash system capable of repeated flashing operations.

Electronic flash systems are in wide use not only in ordinary cameras but also in various cameras designed for specific purposes and there are demands for electronic flash systems which can be operated repeatedly with very short intervals. For example, in fluuorescent photographing of a retina of a patient's eye wherein fluorescent agent is injected to the patient and photographs of the retina are repeatedly taken with predetermined time intervals to record diffusion of the fluorescent agent, it is required to use flashing systems of strong illumination capable of repeating operations 3 to 5 times in a second.

In conventional electronic flash systems, a control of a flashing time is performed utilizing the commutation of a commutation capacitor of which capacity is determined by the quantity of electric current which flows through the flashing tube. In case of the fluorescent photographings of a retina, since it is required to make a large quantity of electric current to flow through the flashing tube, the commutation capacitor must be of a large capacity. On the other hands, such commutation capacitor having a large capacity may have a problem of being insufficiently charged when the flash system is operated very frequently, for example, 3 to 5 times a second, although it is required that the commutation capacitor be fully charged in order to perform an accurate control of the flashing time.

It is therefore an object of the present invention to provide an electronic flash system which can be operated repeatedly with very short time intervals.

Another object of the present invention is to provide an electronic flash which can be operated with a high accuracy of flashing time control even under a repeated operations with very short time intervals.

According to the present invention, the above and other objects can be accomplished by an electronic flash system including a flashing circuit having flashing means for producing a flash of illuminating light when energized and first switching means connected in series with said flashing means, a first bypass circuit having first capacitor means and second switching means connected in series with said first capacitor means, said first bypass circuit being connected in parallel with said first switching means for applying a reverse voltage to said first switching means to thereby turn off the first switching means so that flashing operation of the flashing means is terminated, a charging circuit for charging said first capacitor means, said charging circuit having first resistance means connected in series with said second switching means and second resistance means connected in parallel with said first switching means, a second bypass circuit for applying a reverse voltage to said second switching means to turn off said second switching means, said second bypass circuit having second capacitor means and third switching means connected in parallel with said second switching means, said first resistance means having a resistance value which allows to flow therethrough a current not smaller than a current at which the second switching means is turned off. According to the feature of the present invention, the first resistance means has a low resistance value so that the charge of the commutation capacitor can be carried out rapidly. However, the large quantity of current which is allowed to pass through the first resistance means and the second switching means will maintain the second switching means in the conductive state. Therefore, according to the present invention, there is provided the second bypass circuit to turn off the second switching means. With this arrangement of the present invention, it becomes possible to operate the flash system repeatedly at very short time intervals, for example, 3 to 5 times in a second.

The above and other objects and features of the present invention will become apparent from the following descriptions of preferred embodiments taking reference to the accompanying drawings, in which.

Figure 1:
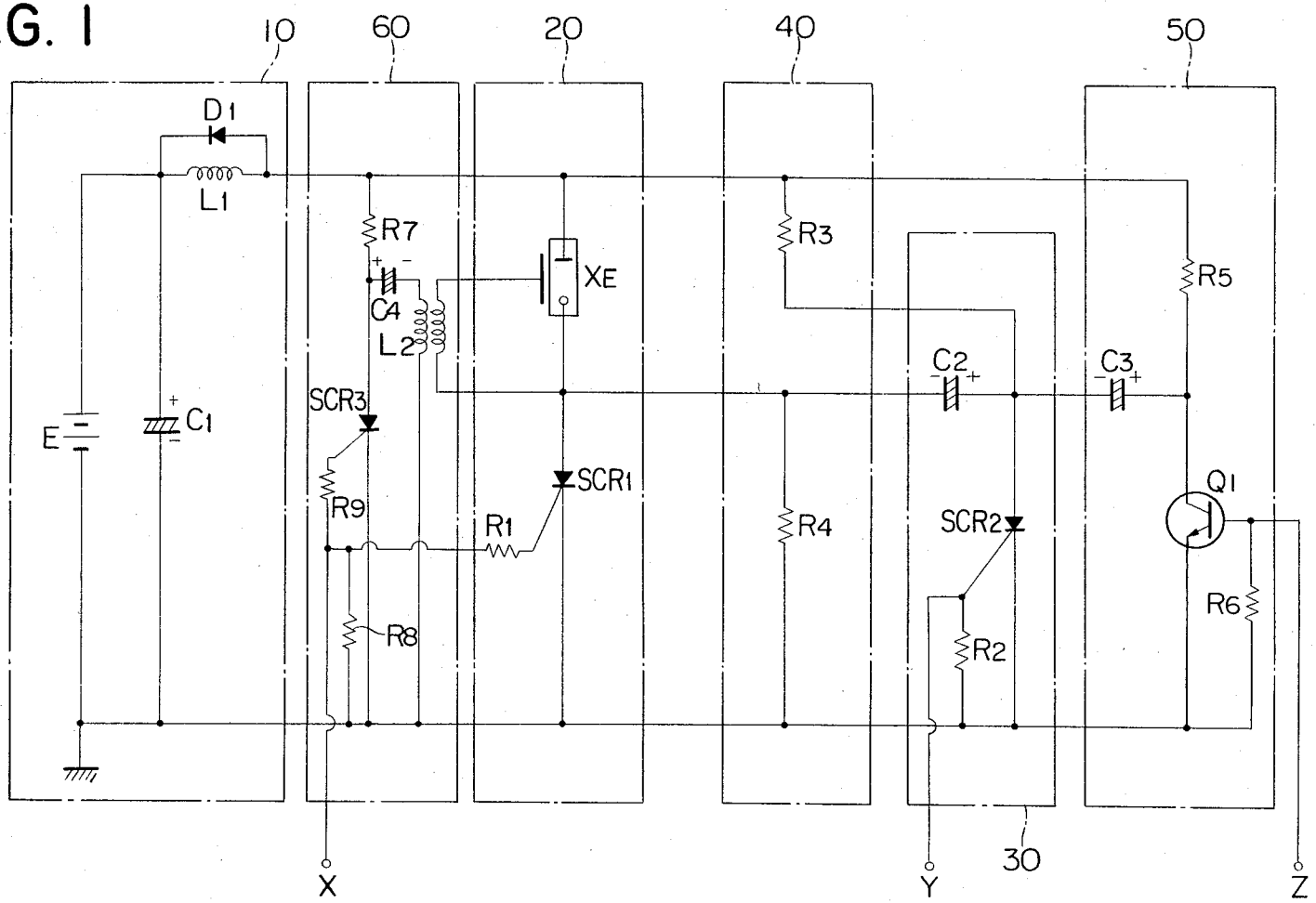
FIG. 1 is a circuit diagram showing an electronic flash system in accordance with one embodiment of the present invention.

Referring now to the drawings, particularly to FIG. 1, the electronic flash system shown therein comprises a main circuit 10, a flashing circuit 20, a first bypass circuit 30, a charging circuit 40, a second bypass circuit 50 and a trigger circuit 60. The main circuit 10 is provided for supplying electric power to the other circuits and includes an electric power source E and a main capacitor $C_1$ connected in parallel with the power source E. Connected with the power source E and the main capacitor $C_1$ in series is an inductance coil $L_1$ which is parallel with a diode $D_1$. The main capacitor $C_1$ functions to supply a large quantity of electric current to the flashing circuit 20 when a flash of illuminating light is being produced. Thus, it is necessary that the capacity of the main capacitor $C_1$ be determined in accordance with the power consumption of the flashing circuit 20. The inductance coil $L_1$ is provided for suppressing momentary currents and the diode $D_1$ for preventing a backlash.

The flashing circuit 20 includes a discharge tube $X_E$ having one pole connected with the induction coil $L_1$ in the main circuit 10 and the other pole grounded through a first thyristor $SCR_1$. The thyristor $SCR_1$ has a triggering gate which is connected through a resistor $R_1$ with a triggering input terminal X. The first bypass circuit 30 is provided for turning off the thyristor $SCR_1$ to de-energize the flashing tube $X_E$ and includes a commutation capacitor $C_2$ and a thyristor $SCR_2$ connected in series with the capacitor $C_2$. The thyristor $SCR_2$ has a triggering gate connected with an input terminal Y and grounded through a resistor $R_2$.

The charging circuit 40 is provided for charging the capacitor $C_2$ and include a resistor $R_3$ having one end connected with the coil $L_1$ of the main circuit 10 and the other end connected with the capacitor $C_2$ at an end connected to the thyristor $SCR_2$. The charging circuit 40 further includes a resistor $R_4$ having one end connected with the other end of the capacitor $C_2$. The other end of the resistor $R_4$ is grounded. The resistor $R_3$ has a resistance value which is sufficiently low so that it allows an electric current to flow through the thyristor $SCR_2$ when the latter is turned on, with a current level substantially equal to or greater than the holding current which is inherent to the thyristor. The aforementioned other end of the capacitor $C_2$ is connected to the thyristor $SCR_1$ at the end connected to the flashing tube $X_E$. The resistor $R_4$ has a resistance value which is sufficient to apply a reverse voltage from the commutation capacitor $C_2$ to the thyristor $SCR_1$.

The second bypass circuit 50 includes at transistor $Q_1$ having a collector connected through a resistor $R_5$ with the coil $L_1$. The collector of the transistor $Q_1$ is also connected through a capacitor $C_3$ with the capacitor $C_2$ and the thyristor $SCR_2$. The transistor $Q_1$ has a base grounded through a resistor $R_6$ and an emitter which is directly grounded. The base of the transistor $Q_1$ is connected with an input terminal Z. The second bypass circuit 50 functions to apply a reverse voltage from the capacitor $C_3$ to the thyristor $SCR_2$ when the transistor $Q_1$ is turned on to thereby turn off the thyristor $SCR_2$.

The trigger circuit 60 is provided for producing a high voltage for triggering the flash tube $X_E$, and includes a transformer $L_2$ having a primary coil connected at one end with one end of a capacitor $C_4$, the other end of the primary coil being grounded. The capacitor $C_4$ has the other end connected on one hand through a resistor $R_7$ with the coil $L_1$ of the main circuit 10 and on the other hand with a thyristor $SCR_3$. The thyristor $SCR_3$ has a triggering gate connected through a resistor $R_9$ with the input terminal X. The resistor $R_9$ is grounded through a resistor $R_8$. The secondary coil of the transformer $L_2$ is connected with the triggering electrode of the flash tube $X_E$.

In operation of the circuit shown in FIG. 1, the thyristors $SCR_1$, $SCR_2$ and $SCR_3$ and the transistor $Q_1$ are all turned off prior to operation. The capacitors $C_1$, $C_2$ and $C_3$ are charged with the polarities shown in FIG. 1. For initiating the flashing operation, a trigger pulse is applied to the input terminal X so that the thyristors $SCR_1$ and $SCR_3$ are turned on. Thus, the capacitor $C_4$ discharges through a loop comprised of the thyristor $SCR_3$ and the primary coil of the transformer $L_2$ to produce a high voltage at the secondary coil of the transformer $L_2$. Thus, a high voltage is applied to the triggering electrode of the flash tube $X_E$ to initiate a discharge in the flash tube $X_E$. The discharge current through the flash tube $X_E$ flows through the thyristor $SCR_1$.

After a predetermined time, a trigger pulse is applied to the input terminal Y so that the thyristor $SCR_2$ is turned on. Thus, the current through the flash tube $X_E$ is allowed to pass through the capacitor $C_2$ to the thyristor $SCR_2$ decreasing the potential at the anode of the thyristor $SCR_1$. This turns off the thyristor $SCR_1$ to thereby de-energize the flash tube $X_E$. When the thyristor $SCR_2$ is thus turned on, the potential at the anode of the thyristor $SCR_2$ is decreased and the capacitor $C_3$ is charged with the polarity shown in FIG. 1.

When a predetermined time is passed after the thyristor $SCR_2$ is turned on, a trigger pulse is applied to the input terminal Z to turn the transistor $Q_1$ on. The predetermined time is determined taking into consideration the time required for having the thyristor $SCR_1$ turned off and the capacitor $C_3$ charged to a level sufficient to turn the thyristor off.

When the transistor $Q_1$ is turned on, the potential at the anode of the thyristor $SCR_2$ is decreased to turn off the thyristor $SCR_2$. At this instance, since the capacitor $C_2$ is charged with a polarity opposite to the shown in FIG. 1 so that the capacitor $C_2$ is now started to be charged by a current through the resistors $R_3$ and $R_4$ to the polarity shown in FIG. 1. Since the resistor $R_3$ has a resistance value which is sufficiently low so as to permit a current flow through the thyristor $SCR_2$ when it is turned on, at a level substantially equal to or larger than the holding current, the charging of the commutation capacitor $C_2$ is completed in a relatively short period. Thus, it becomes possible to operate the system repeatedly with very short intervals.

Figure 2:
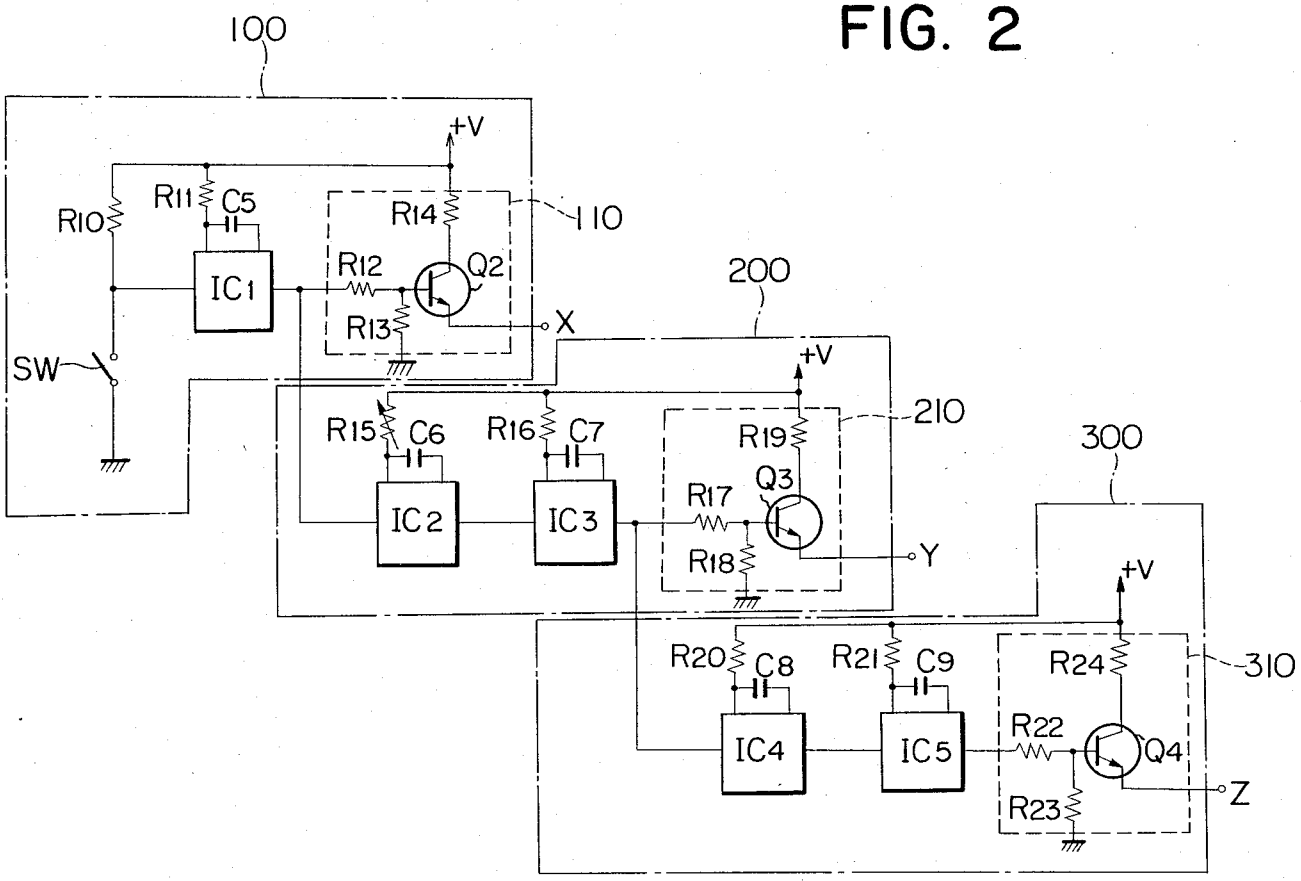
FIG. 2 is a circuit diagram showing a control circuit for controlling the operation of the system shown in FIG. 1.
Figure 3:
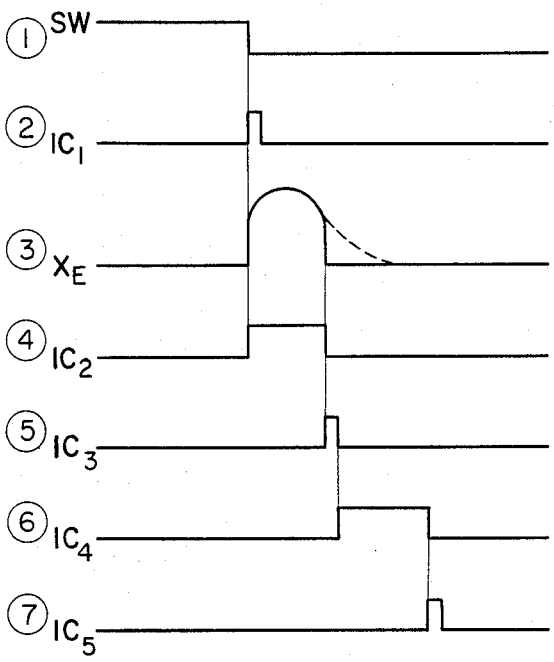
FIG. 3 is a diagram showing signals produced in the control circuit.

Referring now to FIG. 2, the control circuit shown therein includes a first signal section 100, a second signal section 200 and a third signal section 300. The first signal section 100 includes a mono-stable multivibrator $IC_1$ which is connected with a resistor $R_{11}$ and a capacitor $C_5$ for determining the pulse width, and a buffer amplifier 110 connected with the multivibrator $IC_1$. The buffer amplifier 110 includes a transistor $Q_2$ having a collector connected through a resistor $R_{14}$ with a voltage source and a base connected through a resistor $R_{12}$ with the multivibrator $IC_1$ and grounded through a resistor $R_{13}$. Further, the transistor $Q_2$ has an emitter leading to the input terminal X of the electronic flash system. The first signal section 100 further includes a switch SW and a resistor $R_{10}$ connected with the resistor $R_{11}$ and the voltage source. The switch SW may be interconnected with a shutter release button of a camera so that it is closed at the time of photographing. The voltage at the switch SW is shown in FIG. 3(1). The multivibrator $IC_1$ is applied with an input as shown in FIG. 3(1) to start its operation and produces a first control signal a shown in FIG. 3(2). It is desirable that the first control signal be of a short duration so that a termination of the flashing operation is not disturbed.

The first control signal is amplified by the amplifier 110 and passed to the terminal X to initiate the flashing operation. In FIG. 3(3), there is shown the discharge current through the flash tube $X_E$. The output of the multivibrator $IC_1$ is also connected with the second signal section 200.

The section 200 includes a monostable multivibrator $IC_2$ having an input connected with the output of the multivibrator $IC_1$. The multivibrator $IC_2$ is associated with a resistor $R_{15}$ and a capacitor $C_6$ so that an appropriate pulse width is determined. The multivibrator $IC_2$ has an output connected with a multivibrator $IC_3$ which is associated with a resistor $R_{16}$ and a capacitor $C_7$ so that an appropriate pulse width is determined. The multivibrator $IC_3$ has an output which is connected with a buffer amplifier 210. The amplifier 210 includes a transistor $Q_3$ having a collector connected through a resistor $R_{19}$ with the voltage source and a base connected through a resistor $R_{17}$ with the output of the multivibrator $IC_3$. The base of the transistor $Q_3$ is also grounded through a resistor $R_{18}$. The transistor $Q_3$ further has an emitter leading to the input terminal Y of the flash system.

The multivibrator $IC_2$ is applied with the first control signal and produces a pulse signal having a duration corresponding to the flashing time as shown in FIG. 3(4). In order that the pulse duration be adjusted, the resistor $R_{15}$ is of a variable resistance. The multivibrator $IC_3$ receives the pulse output from the multivibrator $IC_2$ and produces a second control signal as shown in FIG. 3(5) which is used for terminating the flashing operation. The duration of the second control signal should be of a suitable value so that the thyristor $SCR_2$ be turned off without fail.

The output of the multivibrator $IC_3$ is also applied to the third signal section 300 which includes a mono-stable multivibrator $IC_4$ having an input connected with the output of the multivibrator $IC_3$. The multivibrator $IC_4$ is associated with a resistor $R_{20}$ and a capacitor $C_8$ so that an appropriate pulse duration is determined. The multivibrator $IC_4$ has an output connected with a mono-stable multivibrator $IC_5$ which is associated with a resistor $R_{21}$ and a capacitor $C_9$ so that an appropriate pulse width is determined.

The multivibrator $IC_4$ receives the second control signal from the multivibrator $IC_3$ and produces a pulse as shown in FIG. 3(6). The multivibrator $IC_5$ receives the pulse from the multivibrator $IC_4$ and produces a third control signal shown in FIG. 3(7). The output of the multivibrator $IC_5$ is connected to a buffer amplifier 310 having a transistor $Q_4$ and resistor $R_{22}$, $R_{23}$ and $R_{24}$. The output of the amplifier 310 is connected to the input terminal Z.

Figure 4:
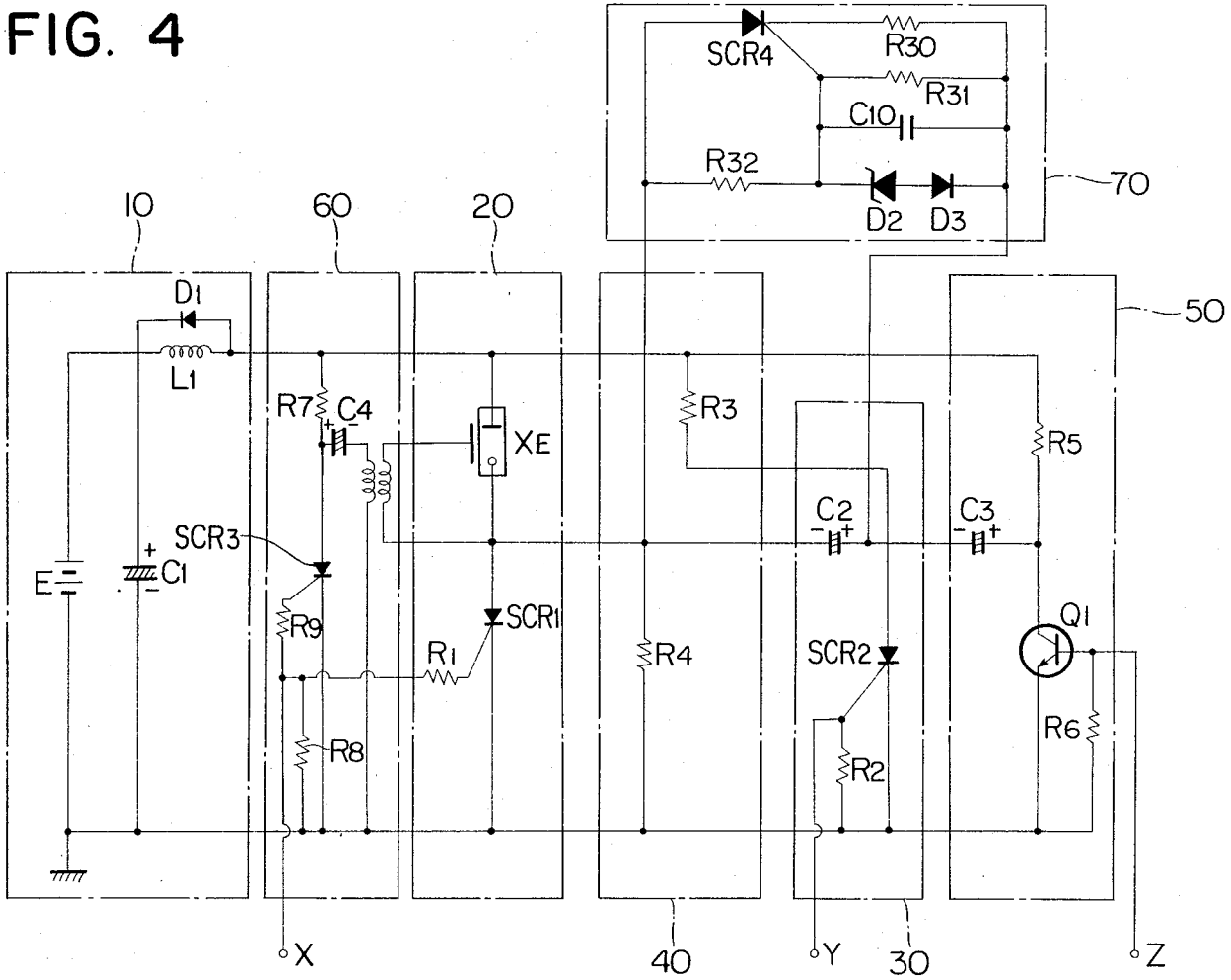
FIG. 4 is a circuit diagram similar to FIG. 1 but showing another embodiment of the present invention.

Referring to FIG. 4, the circuit shown therein is identical with that shown in FIG. 1 except a discharge promoting circuit 70 connected in parallel with the capacitor $C_2$. The circuit 70 includes a thyristor $SCR_4$ and a resistor $R_{30}$ which are connected in series with each other. The thyristor $SCR_4$ and the resistor $R_{30}$ are connected in parallel with the capacitor $C_2$. The thyristor $SCR_4$ has a triggering gate connected through a resistor $R_{31}$ with the capacitor $C_2$ at the end connected with the thyristor $SCR_2$. In parallel with the resistor $R_{31}$, there is a capacitor $C_{10}$. Further, series connected zener diode $D_2$ and diode $D_3$ are connected in parallel with the capacitor $C_{10}$. A resistor $R_{32}$ is connected in parallel with the thyristor $SCR_4$.

With this arrangement, by appropriately determining the resistance values of the resistors $R_{31}$ and $R_{32}$ and the capacitance of the capacitor $C_{10}$, it is possible to have the thyristor $SCR_4$ turned on at a timing close to the timing wherein the flashing operation is terminated and the transistor $Q_1$ is turned on. Then, the thyristor $SCR_4$ is turned on when the charge opposite to the polarity shown in FIG. 4 still remains in the capacitor $C_2$ so that the discharge of the capacitor $C_2$ is promoted. The circuit 70 does not have any influence when the capacitor $C_2$ is being charged to the polarity shown in FIG. 4.

The invention has thus been shown and described with reference to specific embodiments, however, it should be noted that the invention is in no way limited to the details of the illustrated arrangements but changes and modifications may be made without departing from the scope of the appended claims.

I claim:

1. An electronic flash system including a flashing circuit having flashing means for producing a flash of illuminating light when energized and first switching means connected in series with said flashing means, a first bypass circuit having first capacitor means and second switching means connected in series with said first capacitor means, said first bypass circuit being connected in parallel with said first switching means for applying a reverse voltage to said first switching means to thereby turn off the first switching means so that flashing operation of the flashing means is terminated, a charging circuit for charging said first capacitor means, said charging circuit having first resistance means connected in series with said second switching means and second resistance means connected in parallel with said first switching means, a second bypass circuit for applying a reverse voltage to said second switching means to turn off said second switching means, said second bypass circuit having second capacitor means and third switching means which are connected in series with each other, said second bypass circuit being connected in parallel with said second switching means, said first resistance means having a resistance value which allows to flow therethrough a current not smaller than a current at which the second switching means is turned off.

2. An electronic flash system in accordance with claim 1 which further includes means for promoting discharge of said first capacitor means when said first switching means is turned off.

3. An electronic flash system including flashing means for producing a flash of illuminating light, said flashing means having first switching means for controlling operation of said flashing means, first bypass means including first capacitor means and second switching means which are connected in series with each other and connected in parallel with said first switching means, charging means connected with said first capacitor means so that said first capacitor means is charged in one polarity when said second switching means is turned off, first trigger means for turning on the first switching means and initiating operation of the flashing means, second trigger means for turning on the second switching means to make the first capacitor means discharge and apply to the first switching means a voltage with turns off the first switching means to thereby make current from the flashing means flow through said first capacitor means so that the capacitor means is charged in the opposite polarity, second bypass means having second capacitor means and third switching means which are connected together in series and adapted for applying a reverse voltage to the second switching means to turn-off the second switching means, third trigger means for turning off the second switching means, said charging means including resistor means connected between electric power source means and said first capacitor means and having a resistance value which allows a current not smaller than a current at which the second switching means is turned off.

4. An electronic flash in accordance with claim 3 in which means is provided for promoting discharge of said first capacitor means after said first switching means is turned off so that the first capacitor means can be charged quickly to said one polarity when the second switching means is turned off.

5. An electronic flash system in accordance with claim 4 in which said promoting means includes third switching means connected in parallel with the first capacitor means.

* * * * *